US005157418A

United States Patent [19]

Tamura

[11] Patent Number: 5,157,418

[45] Date of Patent: Oct. 20, 1992

[54] INK JET RECORDING HEAD WITH THROUGH-HOLE WIRING CONNECTOR

[75] Inventor: Hideo Tamura, Hiratsuka, Japan

[73] Assignee: Canon Kabushiki Kaisha, Tokyo, Japan

[21] Appl. No.: 668,686

[22] Filed: Mar. 7, 1991

Related U.S. Application Data

[63] Continuation of Ser. No. 360,063, Jun. 1, 1989, abandoned.

[30] Foreign Application Priority Data

Jun. 3, 1988 [JP] Japan ..... 63-136864

[51] Int. Cl.[5] ..... B41J 2/05

[52] U.S. Cl. ..... 346/140 R

[58] Field of Search ..... 346/140 R

[56] References Cited

U.S. PATENT DOCUMENTS

| | | | |
|---|---|---|---|
| 4,458,256 | 7/1984 | Shirato | 346/140 |
| 4,499,480 | 2/1985 | Takatori | 346/140 |
| 4,862,197 | 8/1989 | Stoffel | 346/140 |
| 4,947,192 | 8/1990 | Hawkins | 346/140 |

FOREIGN PATENT DOCUMENTS

| | | |
|---|---|---|
| 3008487 | 9/1980 | Fed. Rep. of Germany . |
| 3412918 | 10/1984 | Fed. Rep. of Germany . |
| 208248 | 10/1985 | Japan . |
| 2119317 | 11/1983 | United Kingdom . |
| 2139565 | 11/1984 | United Kingdom . |

*Primary Examiner*—Joseph W. Hartary

*Attorney, Agent, or Firm*—Fitzpatrick, Cella, Harper & Scinto

[57] ABSTRACT

A substrate for a liquid emission recording head, comprises: a support member, plural electrothermal converting elements formed on the support member and each provided with a heat generating resistor layer, a common electrode wiring layer and an individual electrode wiring layer both connected to the heat generating resistor layer, and a protective layer for the above-mentioned layers; an insulating layer formed on the common electrode wiring layer; and a common electrode connected in common to the plural common electrode wiring layers across the insulating layer by through-holes provided in the insulating layer.

In one embodiment the insulating layer covers the protective layer and is in contact with the common electrode wiring layer in the through-holes. In another embodiment, the protective and insulating layers are formed as steps on the common electrode wiring layer.

16 Claims, 6 Drawing Sheets

INK JET RECORDING HEAD WITH THROUGH-HOLE WIRING CONNECTOR

This application is a continuation of application Ser. No. 07/360,063 filed Jun. 1, 1989, now abandoned.

BACKGROUND OF THE INVENTION

1. Field of the Invention

The present invention relates to a recording head for emitting recording liquid from a discharge opening to generate flying droplets, thereby effecting recording, a substrate for said head, and a liquid emission recording apparatus equipped with said recording head.

2. Related Background Art

In the conventional liquid emission recording head, the common electrode of the wiring is constructed, for example, as disclosed in U.S. Pat. No. 4, 499,480. FIG. 1 is a schematic plan view of a substrate for the conventional liquid emission recording head, and FIG. 2 is a schematic cross sectional view along a line II—II' in FIG. 1, wherein shown is a substrate 11 for the liquid emission recording head. There are also shown a heat-generating resistor layer 3 composed of $HfB_2$ and formed on a substrate 15; an aluminum wiring layer 4 for the common electrode; an aluminum layer 5 for the individual electrodes; an anti-oxidation protective layer 6 composed of $SiO_2$; an anti-cavitation protective layer 7 composed of Ta; and an ink-resistant protective layer 8 composed of photosensitive polyimide. The heat-generating resistor layer 3, wiring layers 4, 5 and protective layers 6, 7, 8 constitute an electrothermal converting element for generating thermal energy to be utilized in the emission of liquid from the discharge opening.

After the principle portions of said substrate 11 for the liquid emission recording head are completed, a common electrode member 13 consisting of a copper-laminated glass-epoxy board is adhered to a broken-lined portion 12, and said common electrode member 13 and the common electrode wiring 4 are connected by wire bonding. This state is shown in FIG. 3 and FIG. 4 which a schematic cross-sectional view along a line IV—IV' in FIG. 3, in which same components as those shown in FIGS. 1 and 2 are represented by same numbers. In FIG. 4, there is shown a wire 14 connected by wire bonding.

However, such conventional structure, requiring the preparation of wiring member (common electrode 13 etc.) separate from the liquid emitting part and the subsequent connection of said wiring member for example wire bonding, is associated with the drawbacks of having a complex preparation procedure and the eventual disconnection of the wire bonding even after the completion of the procedure.

Particularly in the liquid emission recording head of the so-called full line type in which the discharge openings are provided corresponding to the full line width of the recording material, the number of wire bondings to corresponds to the number of said discharge openings. Consequently the process is very complex and requires high precision and secure operations, and the head is still associated with the drawbacks of increased possibility of wire disconnection because of the increased number of bonding wires and cumbersome preparation of the common electrode member corresponding to the width of said recording head.

U.S. Pat. No. 4,458,256 to Shirato, et al. relates to an ink jet recording apparatus including actuating portions and lead electrodes for conducting current. The lead electrodes are wired in such a manner that a conductive member is disposed on a surface which is at a side where the ink droplets are ejected. The conductive member is a part of the lead electrode, or one actuating portion is provided with a plurality of lead electrodes, and these electrodes are led, substantially in parallel, to terminals which are located at a side opposite to the ejection port with respect to the actuating portion, or one chamber is provided with a plurality of actuating portions which are separated from one another, and lead electrodes connected to the actuating portions are led, substantially in parallel, to terminals which are located at a side opposite to the ejection port with respect to the actuating portion, or the actuating portion is disposed on a conductive member intervened with an insulating layer and the conductive member is a part of the lead electrode. In one embodiment, the electrode lead and the terminal may be connected by means of a through hole.

Japanese Patent Publication No. 60-208,248 relates a heat generating resistance layer and a selection electrode which are laminated to the upper surface of a substrate. The heat generating resistance layer, a common electrode and a selection electrode are respectively patterned at desired positions in predetermined shape and size such that a heat generation part is arranged between a common electrode and the selection electrode. The common electrode is connected to the heat generating resistance layer at the terminal part thereof and this terminal part is integrated with a conductive support through the electrode in a through-hole while the selection electrode is arranged only to the upper surface of the substrate. Therefore, the common electrode and the selection electrodes are separately arranged to the front and back surfaces of the substrate through an insulating layer.

SUMMARY OF THE INVENTION

In consideration of the foregoing, an object of the present invention is to provide a liquid emission recording head which can be produced with a very simple process and with a low cost, and which still has high precision and reliability for example of the electrical connections.

Another object of the present invention is to provide a substrate for a liquid emission recording head, provided with a support member; plural electrothermal converting elements each having a heat-generating resistor layer, a common electrode wiring layer and an individual electrode wiring layer both connected to said heat-generating resistor layer, and a protective layer for the aforementioned layers; an insulating layer provided on said common electrode wiring layer; and a common electrode connected in common to said plural common electrode wiring layers across said insulating layer by through-holes provided therein.

Still another object of the present invention is to provide a liquid emission recording head, having liquid paths formed on the above-mentioned substrate corresponding to the heat-generating areas formed between said common electrode wiring layer and said individual electrode wiring layers, wherein the liquid is emitted from discharge openings communicating with said liquid paths utilizing thermal energy generated in said heat-generating areas.

Still another object of the present invention is to provide a liquid emission recording apparatus equipped with the above-mentioned liquid emission recording head, and switch means of a power source for driving said recording head.

DETAILED DESCRIPTION OF THE PREFERRED EMBODIMENTS

Figure 1:
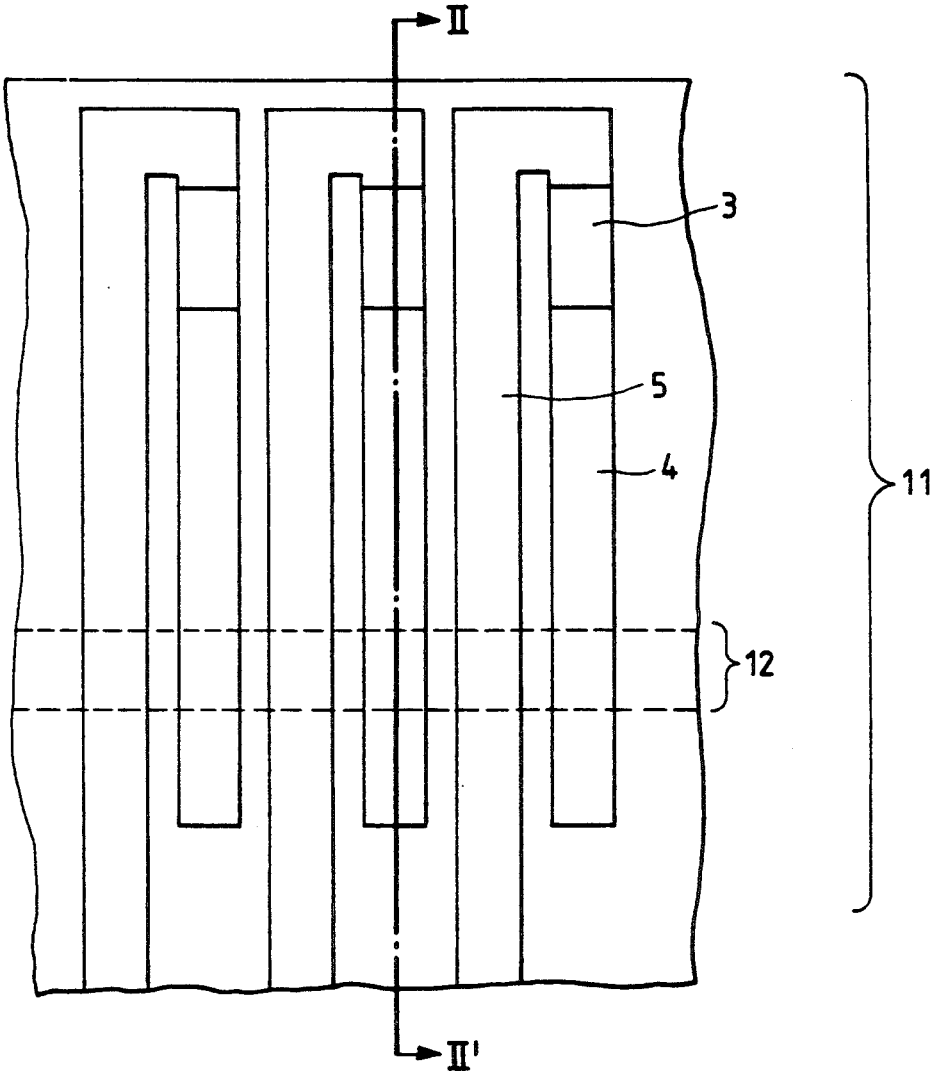
FIG. 1 PRIOR ART
FIG. 1 is a schematic plan view of the principle portion of a substrate for a conventional liquid emission recording head.
Figure 2:
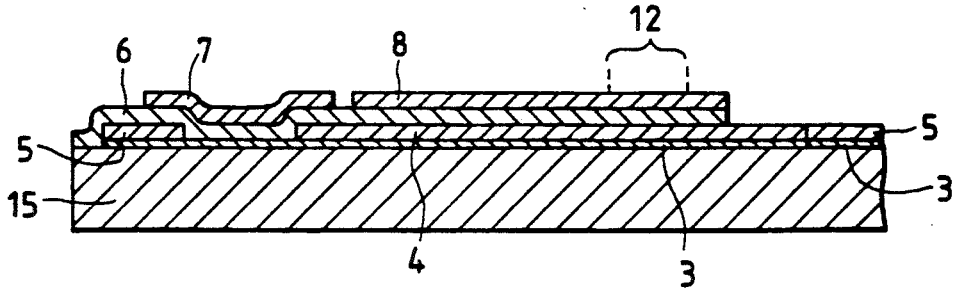
FIG. 2 PRIOR ART
FIG. 2 is a schematic cross-sectional view along a line II—II' in FIG. 1.
Figure 3:
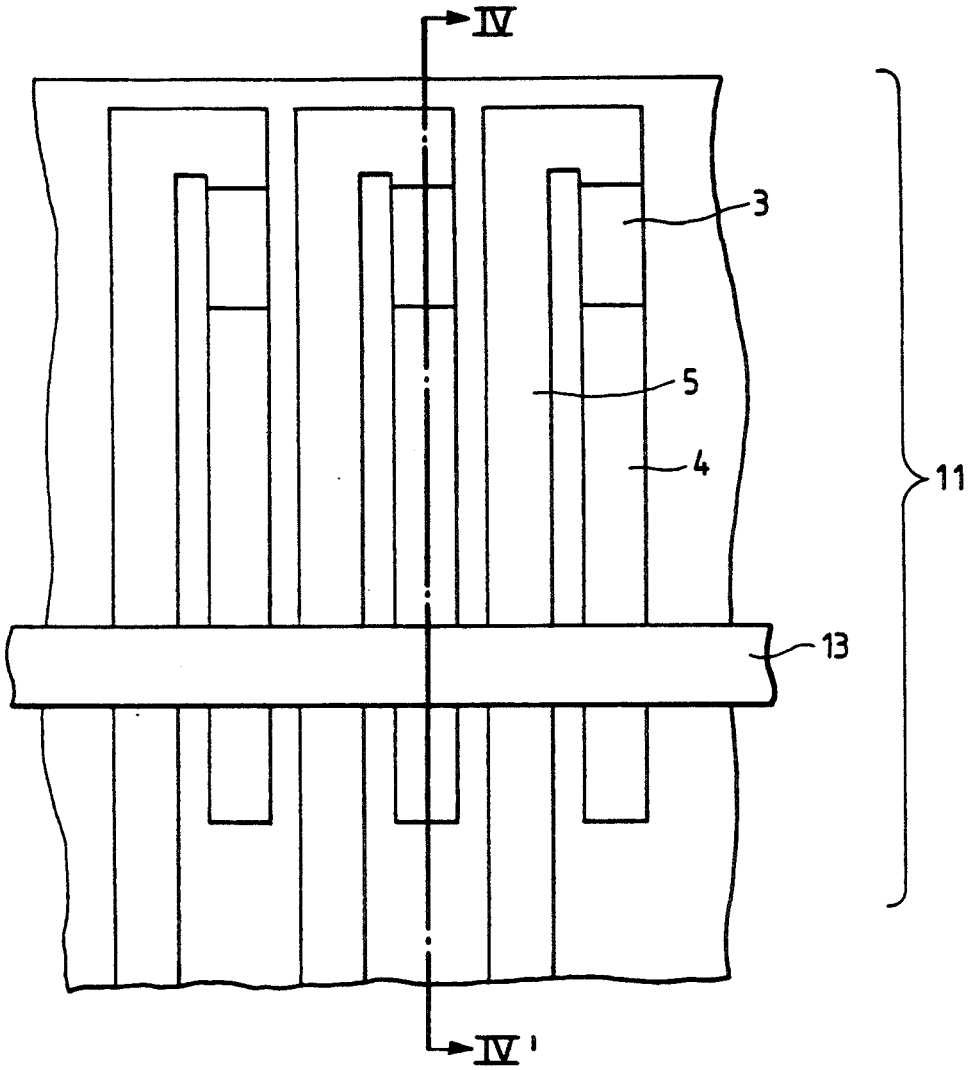
FIG. 3 PRIOR ART
FIG. 3 is a schematic plan view of the principle portion of the substrate for the liquid emission recording head shown in FIG. 1, with a common electrode member and with wire bonding.
Figure 4:
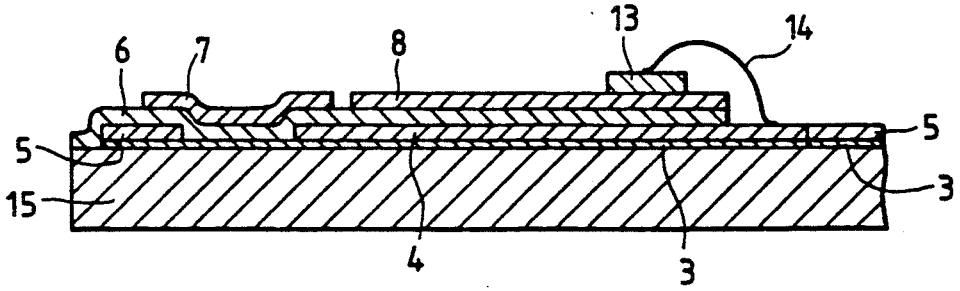
FIG. 4 PRIOR ART
FIG. 4 is a schematic cross-sectional view along a line IV—IV' in FIG. 3.
Figure 5:
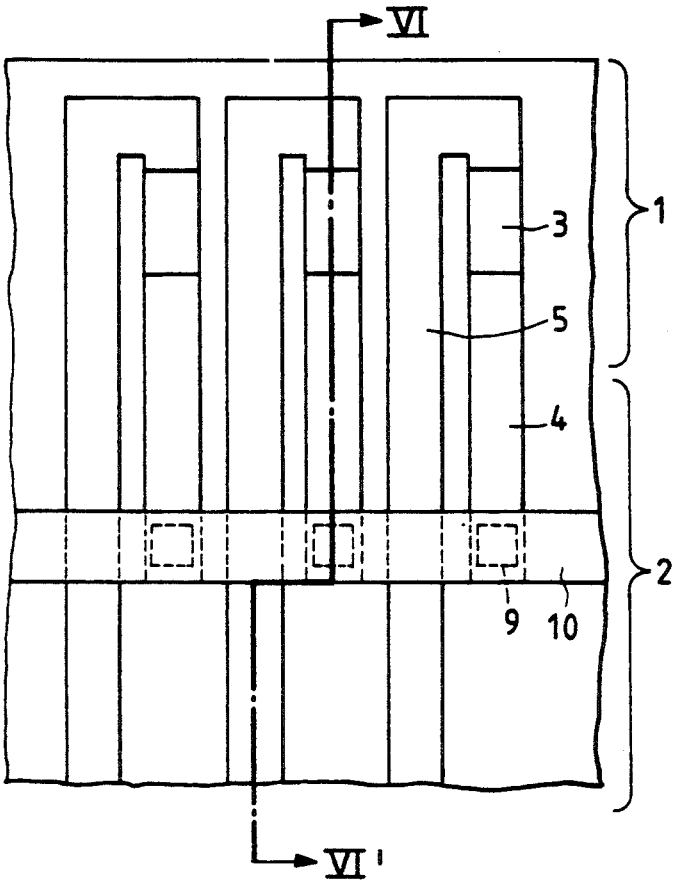
FIG. 5 is a schematic plan view of the principal portion of a substrate for a liquid emission recording head constituting an embodiment of the present invention.
Figure 6:
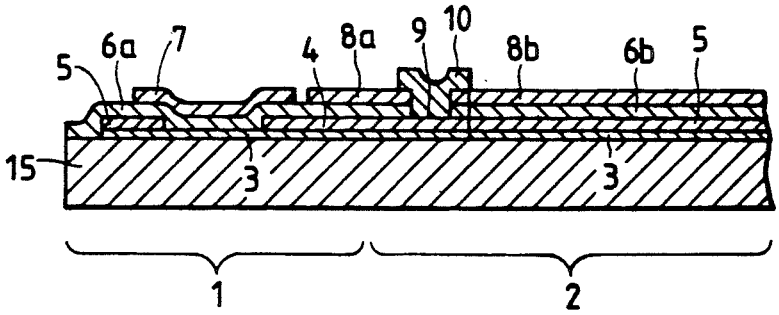
FIG. 6 is a schematic cross-sectional view along a line VI—VI' in FIG. 5.

Now the present invention will be clarified in detail by embodiments thereof shown in the attached drawings. FIG. 5 is a schematic plan view of the principal portion of a substrate for the liquid emission recording head constituting an embodiment of the present invention, and FIG. 6 is a schematic cross-sectional view along lines VI—VI' in FIG. 5. In these drawings there are generally shown a liquid emitting portion 1, and a wiring portion 2.

Referring to FIG. 6, an anti-oxidation protective layer 6*a* of the liquid emitting portion 1 and an inter-layer insulating layer 6*b* of the wiring portion 2, are both formed with $SiO_2$ and simultaneously prepared in a same step. An ink-resistant protective layer 8*a* of the liquid emitting portion 1 and an interlayer insulating layer 8*b* of the wiring portion 2 are both formed with photosensitive polyimide resin and simultaneously formed in a same step.

In the following there will be explained the manufacturing process of the present embodiment.

(1) At first a $HfB_2$ film of a thickness of 1,000 Å is prepared by sputtering as the heat-generating resistor layer 3, and is patterned with fluoric-nitric wet etch to obtain the pattern shown in FIG. 5;

(2) Then an aluminum film of a thickness of 5,000 Å is prepared by sputtering as the common electrode wiring layer 4 and the individual electrode wiring layer 5, and is patterned with acetic-nitric-phosphoric wet etch to obtain the pattern shown in FIG. 5;

(3) A $SiO_2$ film of a thickness of 2 microns is formed by sputtering as the anti-oxidation protective layer 6*a* and the inter-layer insulating layer 6*b*, and is patterned with reactive ion etching utilizing $CF_4$ gas to form through-holes 9;

(4) A Ta film of a thickness of 5,000 Å prepared by sputtering the anti-cavitation protective layer 7, and is patterned with fluoric-nitric wet etching so as to cover the heat-generating portion between the wiring layers 4 and 5;

(5) Photosensitive polyimide resin photoneece supplied by Toray Corp.) is applied with a thickness of 2 microns as the ink-resistant protective layer 8*a* and the inter layer insulating layer 8*b*, and is patterned by photolithography to form through-holes 9;

(6) A TiCu film of a thickness of 5,000 Å is prepared by sputtering as the common electrode 10, and is patterned by wet etching to obtain the pattern shown in FIG. 5, whereby the common electrode 10 is connected to the common electrode wiring layers 4 by the throughholes 9; and (7) Finally the common electrode 10 is plated with a Cu-Ni-Au alloy film of a thickness of 10 microns, in order to improve the conductivity of the common electrode 10.

Figure 7:
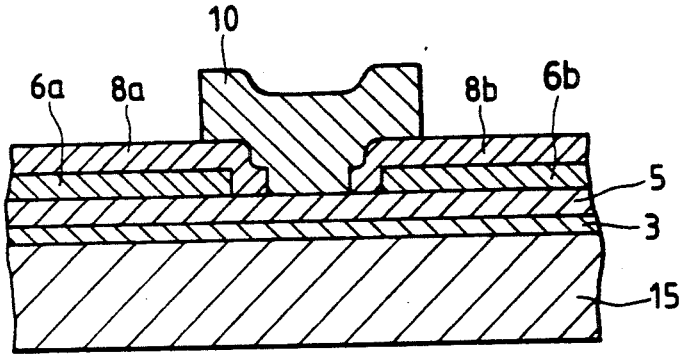
FIGS. 7 and 8 are schematic cross-sectional views showing other embodiment of peripheral structure of a common electrode 10 shown in FIG. 6.

FIG. 7 is a schematic cross-sectional view showing another embodiment of the structure around the common electrode 10 shown in FIG. 6.

In this embodiment, the organic protective layers 8*a*, 8*b* are so formed as to cover the protective layers 6*a*, 6*b*, whereby the protective layers 8*a*, 8*b* of low pinhole frequency adhere strongly to the wiring layer 5, thus providing a mechanically strong substrate for the liquid emission recording head.

Figure 8:
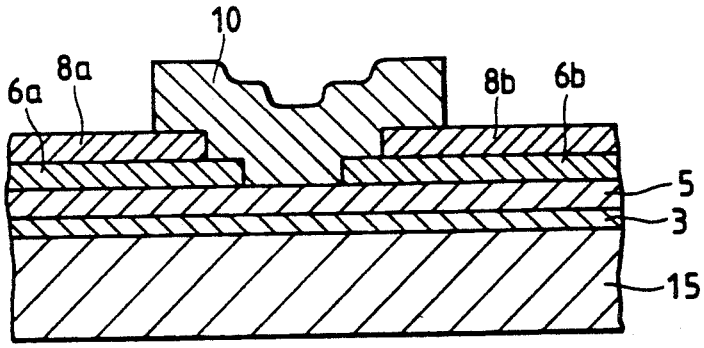

FIG. 8 is a schematic cross-sectional view showing still another embodiment of the structure around the common electrode 10 shown in FIG. 6.

In this embodiment the protective layers 6*a*, 6*b* and the protective layers 8*a*, 8*b* are formed stepwise to improve the step coverage of the common electrode 10, thereby providing a substrate with improved electrical connections for the liquid emission recording head.

Figure 9:
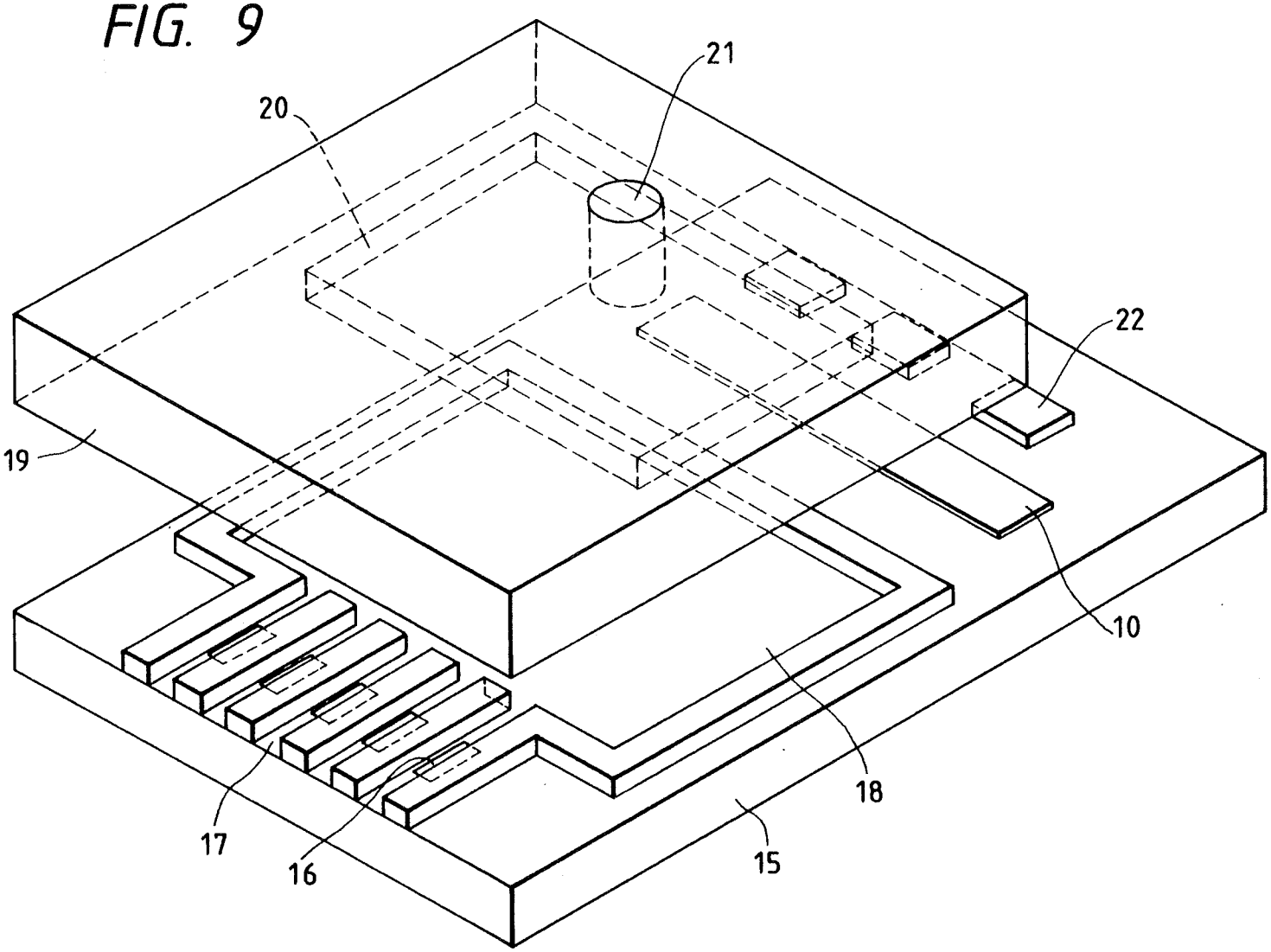
FIG. 9 is a schematic perspective view, in a partially disassembled state, of an embodiment of the liquid emission recording head of the present invention.

FIG. 9 is a schematic perspective view, in a partially disassembled state, of a liquid emission recording head of the present invention, prepared with the substrate prepared in the above-explained manner.

In FIG. 9, numeral 16 indicates heat generating parts of the thermal energy generating elements formed between the wiring layers 4, 5, and there are formed, corresponding to said heat generating parts, liquid paths communicating with discharge openings 17 and having a common liquid chamber 18.

A cover plate 19 for forming said liquid paths is provided with a recess 20 corresponding to said common liquid chamber 18 and a supply aperture 21 for supplying said common liquid chamber 18 with the recording liquid.

Numeral 10 schematically shows the common electrode shown in FIGS. 5 and 6, and said common electrode 10 and individual electrode wiring layers 5 (not shown in FIG. 9) are connected to a driving circuit component 22.

Figure 10:
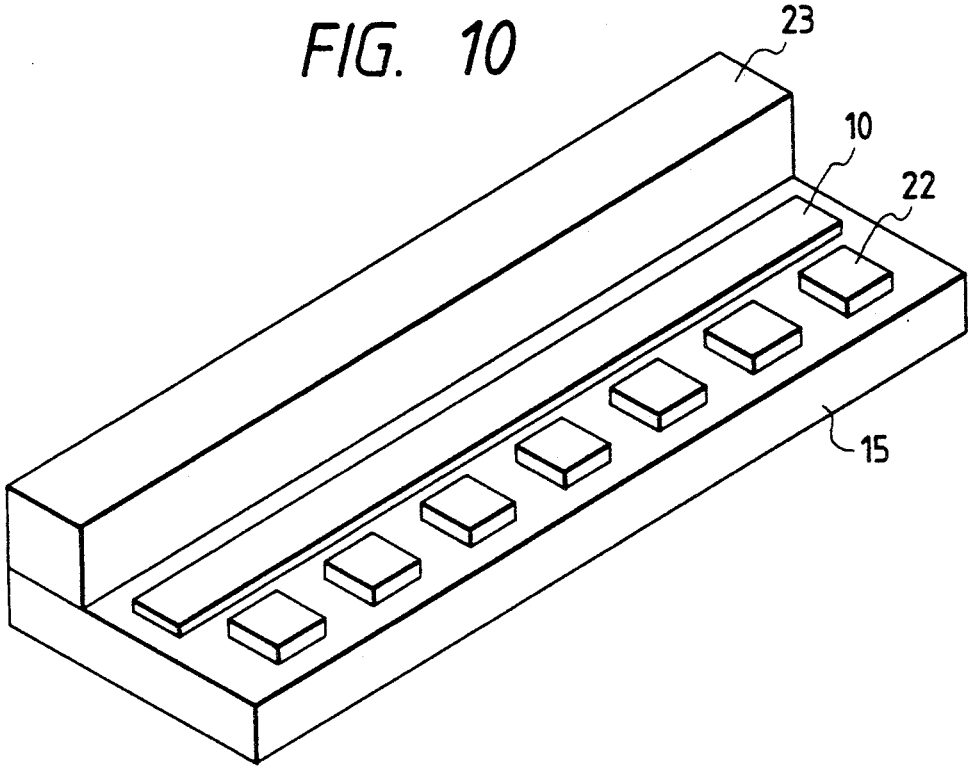
FIG. 10 is a schematic perspective view of another embodiment of the liquid emission recording head of the present invention.

FIG. 10 is a schematic perspective view of another embodiment of the liquid emission recording head of the present invention, seen from a side opposite to the discharge openings.

The liquid emission recording head of this embodiment is the so called full-line type, provided with discharge openings over the entire line width of the recording material, wherein the same components as those in FIG. 9 are represented by same numbers. Numeral 23 indicates collectively the member constituting the walls of the liquid paths shown in FIG. 9 and the cover plate 19.

In the foregoing embodiments, the direction of liquid emission from the discharge openings is substantially the same as the direction of supply of the recording liquid in the liquid path to the heat generating part of the thermal energy generating element, but the present invention is not limited to such embodiments. For example it is likewise applicable to the liquid emission recording heads in which said two directions are mutually different, for example mutually perpendicular.

Also the materials and method of preparation of the layers constituting the liquid emission recording head of the present invention are not limited to those described in the foregoing embodiments, but can be those commonly employed in the preparation of the liquid emission recording head.

Figure 11:
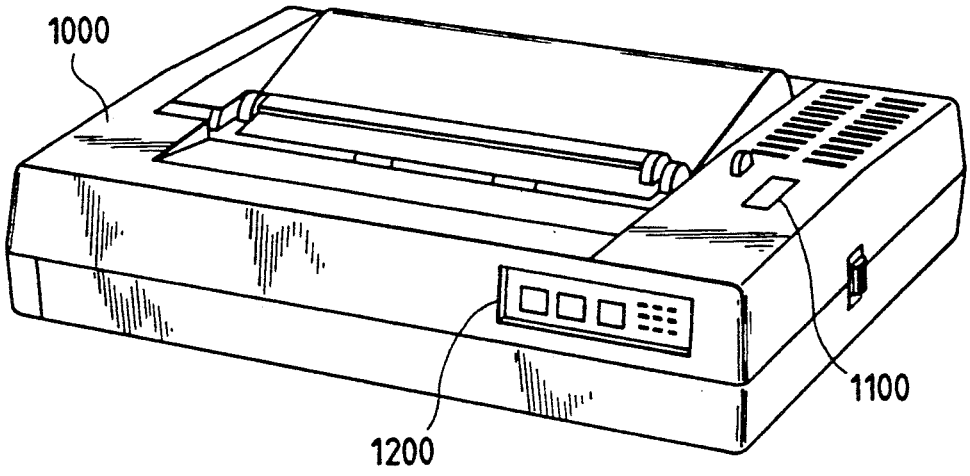
FIG. 11 is a schematic perspective view of a liquid emission recording apparatus equipped with the liquid emission recording head of the present invention.

FIG. 11 is a schematic perspective view of a liquid emission recording apparatus equipped with a liquid emission recording head of the present invention, wherein shown are a main body 1000, a switch 1100 for the power supply for driving said recording head, and an operation panel 1200.

As explained in the foregoing, the present invention allows the preparation of the liquid emission portion and the wiring portion of the liquid emission recording head simultaneously in a same gaseous process, and the prevention of the drawbacks in the prior technology such as the disconnection of bonding wires after the preparation of the recording head.

Consequently the present invention allows the production of the liquid emission recording head with a very simple process and with a reduced cost and still ensures high precision and reliability with respect for example to the electrical connections.

The present invention is particularly effective in simplifying the process for producing the recording head, when the protective layer of the liquid emitting portion and the inter-layer insulating layer of the wiring portion are simultaneously prepared in the same process.

I claim:

1. A substrate for an ink jet recording head, said substrate comprising:

a support member;

a plurality of electrothermal converting elements formed on said support member and each comprising a heat generating resistor layer, a common electrode wiring layer and an individual electrode wiring layer both connected to said heat generating resistor layer, and a protective layer for the above-mentioned layers;

an insulating layer formed over said common electrode wiring layer, said insulating layer covering said protective layer and including a portion forming through-holes and contacting said common electrode wiring layers with the portion forming said through-holes; and a common electrode connected in common to said plurality of common electrode wiring layers across said insulating layer through the through-holes provided in said insulating layer.

2. A substrate according to claim 1 wherein each said protective layer and each said insulating layer comprises a single film.

3. An ink jet recording head comprising ink paths formed on a substrate, said ink jet recording head comprising:

a support member;

a plurality of electrothermal converting elements formed on said support member and each provided with a heat generating resistor layer, a common electrode wiring layer and an individual electrode wiring layer both connected to said heat generating resistor layer, and a protective layer for the above-mentioned layers;

an insulating layer formed over said common electrode wiring layer, said insulating layer comprising a portion forming through-holes; and a common electrode connected in common to said plural common electrode wiring layers across said insulating layer through the through-holes provided in said insulating layer, said insulating layer covering said protective layer and contacting said common electrode wiring layers with the portion forming said through-holes;

each ink path corresponding to a heat generating portion, each heat generating portion including a portion of one of said heat generating resistor layers between one of said common electrode wiring layers and one of said individual electrode wiring layers, wherein a discharge opening communicating with each of said ink paths is adapted to discharge ink by means of thermal energy generated by said heat generating portion.

4. An ink jet recording head according to claim 3, wherein the number of said discharge openings is dependent on the width of recording area of a record receiving material.

5. An ink jet recording head according to claim 3, wherein the direction of ink discharge from said discharge opening is generally the same as the direction of ink supply to said heat generating portion.

6. An ink jet recording head according to claim 3, wherein the direction of ink discharge from said discharge opening is different from the direction of ink supply to said heat generating portion.

7. An ink jet recording head according to claim 6, wherein the two directions are generally perpendicular.

8. An ink jet recording apparatus comprising:

an ink jet recording head including a support member, a plurality of electrothermal converting elements formed on said support member and each provided with a heat generating resistor layer, a common electrode wiring layer and an individual electrode wiring layer both connected to said heat generating resistor layer, and a protective layer for the above-mentioned layers, an insulating layer formed over said common electrode wiring layer, said insulating layer comprising a portion forming through-holes, and a common electrode connected in common to said plural common electrode wiring layers across said insulating layer through the through-holes provided in said insulating layer, said insulating layer covering said protective layer and contacting said common electrode wiring layers with the portion forming said through-holes, each ink path corresponding to a hat generating portion, said heat generating portion including a portion of one of said heat generating resistor layers between one of said common electrode wiring layers and one of said individual electrode wiring layers, wherein a discharge opening communicating with each of said ink paths is adapted to discharge ink by means of thermal energy generated by said heat generating portion; and switch means for activating a power supply for driving said ink jet recording head.

9. A substrate for an ink jet recording head, said substrate comprising:

a support member;

a plurality of electrothermal converting elements formed on said support member and each comprising a heat generating resistor layer, a common electrode wiring layer and an individual electrode wiring layer both connected to said heat generating resistor layer, and a protective layer for the above-mentioned layers;

an insulating layer formed over said common electrode wiring layer, said insulating layer comprising through-holes; and a common electrode connected in common to said plurality of common electrode wiring layers across said insulating layer through the through-holes provided in said insulating layer, said protective layer and said insulating layer being formed as steps, in cross-section, over said common electrode wiring layer to form said through-holes.

10. A substrate according to claim 9, wherein each said protective layer and each said insulating layer comprise a single film.

11. An ink jet recording head comprising ink paths formed on a substrate, said substrate further comprising:

a support member;

a plurality of electrothermal converting elements formed on said support member and each comprising a heat generating resistor layer, a common electrode wiring layer and an individual electrode wiring layer both connected to said heat generating resistor layer, and a protective layer for the above-mentioned layers;

an insulating layer formed over said common electrode wiring layer, said insulating layer comprising through-holes; and a common electrode connected in common to said plural common electrode wiring layers across said insulating layer through the through-holes provided in said insulating layer, said protective layer and said insulating layer being formed as steps, in cross-section, over said common electrode wiring layer to form said through-holes;

each ink path corresponding to a heat generating portion, each heat generating portion including a portion of one of said heat generating resistor layers between one of said common electrode wiring layers and one of said individual electrode wiring layers, wherein a discharge opening communicating with each of said ink paths is adapted to discharge ink by means of thermal energy generating by said heat generating portion.

12. An ink jet recording head according to claim 11, wherein the number of said discharge openings is dependent on the width of recording area of a record receiving material.

13. An ink jet recording head according to claim 11, wherein the direction of ink discharge from said discharge opening is generally the same as the direction of ink supply to said heat generating portion.

14. An ink jet recording head according to claim 11, wherein the direction of ink discharge from said discharge opening is different from the direction of ink supply to said heat generating portion.

15. An ink jet recording head according to claim 14, wherein the two directions are generally perpendicular.

16. An ink jet recording apparatus comprising:

an ink jet recording head having ink paths formed on a substrate, the substrate including a support member, a plurality of electrothermal converting elements formed on said support member and each comprising a heat generating resistor layer, a common electrode wiring layer and an individual electrode wiring layer both connected to said heat generating resistor layer, and a protective layer for the above-mentioned layers;

an insulating layer formed over said common electrode wiring layer, said insulating layer comprising through-holes, and a common electrode connected in common to said plural common electrode wiring layers across said insulating layer through the through-holes provided in said insulating layer, said protective layer and said insulating layer being formed as steps, in cross-section, over said common electrode wiring layer to form said through-holes;

each ink path corresponding to a heat generating portion, each heat generating portion including a portion of one of said heat generating resistor layers between one of said common electrode wiring layers and one of said individual electrode wiring layers, wherein a discharge opening communicating with each of said ink paths is adapted to discharge ink by means of thermal energy generated by said heat generating portion; and switch means for activating a power supply for driving said ink jet recording head.

* * * * *

UNITED STATES PATENT AND TRADEMARK OFFICE

CERTIFICATE OF CORRECTION

PATENT NO. : 5,157,418

DATED : October 20, 1992

INVENTOR(S) : HIDEO TAMURA

It is certified that error appears in the above-identified patent and that said Letters Patent is hereby corrected as shown below:

COLUMN 1

Line 10, "a" should read --a liquid emission--.
Line 52, "example" should read --example,--.

COLUMN 4

Line 11, "resin photoneece" should read --resin (Photoneece--.

COLUMN 5

Line 66, "claim 1" should read --claim 1,--.

COLUMN 8

Line 31, "layers;" should read --layers,--.
Line 41, "through-holes;" should read --through-holes,--.

Signed and Sealed this

Seventh Day of December, 1993

Bruce Lehman

*Attest:*

BRUCE LEHMAN

*Attesting Officer*

*Commissioner of Patents and Trademarks*